US011235545B2

(12) United States Patent
Kurokawa

(10) Patent No.: US 11,235,545 B2
(45) Date of Patent: Feb. 1, 2022

(54) PRESS SYSTEM AND CONTROL METHOD FOR PRESS SYSTEM

(71) Applicant: KOMATSU INDUSTRIES CORPORATION, Kanazawa (JP)

(72) Inventor: Takahiko Kurokawa, Nonoichi (JP)

(73) Assignee: KOMATSU INDUSTRIES CORPORATION, Kanazawa (JP)

( * ) Notice: Subject to any disclaimer, the term of this patent is extended or adjusted under 35 U.S.C. 154(b) by 269 days.

(21) Appl. No.: 16/343,824

(22) PCT Filed: Dec. 4, 2017

(86) PCT No.: PCT/JP2017/043421
§ 371 (c)(1),
(2) Date: Apr. 22, 2019

(87) PCT Pub. No.: WO2018/179593
PCT Pub. Date: Oct. 4, 2018

(65) Prior Publication Data

US 2019/0248091 A1 Aug. 15, 2019

(30) Foreign Application Priority Data

Mar. 27, 2017 (JP) ..... JP2017-060885

(51) Int. Cl.
*B30B 15/00* (2006.01)
*B30B 15/14* (2006.01)
(Continued)

(52) U.S. Cl.
CPC ..... *B30B 15/28* (2013.01); *B30B 1/26* (2013.01); *B30B 13/00* (2013.01); *B30B 15/0094* (2013.01); *B30B 15/14* (2013.01)

(58) Field of Classification Search
CPC ..... B30B 15/14; B30B 15/22; B30B 15/26; B30B 15/28; B30B 15/0094; B30B 13/00; G01L 5/00; B21D 55/00
See application file for complete search history.

(56) References Cited

U.S. PATENT DOCUMENTS 4,633,720 A * 1/1987 Dybel ..... B30B 15/26 73/862.53
4,918,956 A * 4/1990 Schoch ..... B21D 51/383 72/21.1
(Continued)

FOREIGN PATENT DOCUMENTS

CN 103009669 A 4/2013
CN 105352832 A 2/2016
(Continued)

*Primary Examiner* — Jimmy T Nguyen
(74) *Attorney, Agent, or Firm* — Faegre Drinker Biddle & Reath LLP

(57) ABSTRACT

A press system includes: a press device configured to perform press working on a workpiece; a detection device configured to detect a press load applied for the press working by the press device; a number acquisition device configured to acquire a number of cycles of press loading, for each section of a plurality of sections into which a press loading region over a total length of a slide stroke is divided; a stress calculation device configured to calculate a stress applied to the press device, the stress corresponding to the press load for each section of the press loading region; and a degree-of-fatigue calculation device configured to calculate a degree of fatigue of the press device, based on respective stresses applied to the press device and respective numbers of cycles of press loading, for the plurality of sections of the press loading region.

6 Claims, 7 Drawing Sheets

(51) Int. Cl.

| | |
|---|---|
| ***B30B 15/28*** | (2006.01) |
| ***B30B 1/26*** | (2006.01) |
| ***B30B 13/00*** | (2006.01) |

(56) References Cited

U.S. PATENT DOCUMENTS

| | | | |
|---|---|---|---|
| 2017/0217116 | A1 | 8/2017 | Takeuchi |
| 2018/0290414 | A1 | 10/2018 | Kurokawa |

FOREIGN PATENT DOCUMENTS

| | | | |
|---|---|---|---|
| CN | 106536177 | A | 3/2017 |
| JP | S58-81600 | A | 5/1983 |
| JP | S59-034898 | U | 3/1984 |
| JP | H03-53838 | Y2 | 11/1991 |
| JP | H08-1396 | A | 1/1996 |
| JP | H10-180495 | A | 7/1998 |
| JP | 2016-209886 | A | 12/2016 |

* cited by examiner

| SLIDE STROKE LENGTH | MAXIMUM LOAD | STRESS |
|---|---|---|
| 90-100 | P10 | σ10 |
| 80-90 | P9 | σ9 |
| 70-80 | P8 | σ8 |
| 60-70 | P7 | σ7 |
| 50-60 | P6 | σ6 |
| 40-50 | P5 | σ5 |
| 30-40 | P4 | σ4 |
| 20-30 | P3 | σ3 |
| 10-20 | P2 | σ2 |
| 0-10 | P1 | σ1 |
| 0-100 | P0 | σ0 |

(A)

(B)

$$D = \frac{n1}{N1} + \frac{n2}{N2} + \cdots + \frac{ni}{Ni} = \sum \frac{ni}{Ni} = \sum \Delta Di$$

D>=1 : POSSIBILITY OF FATIGUE FAILURE

D<1 : NO POSSIBILITY OF FATIGUE FAILURE

PRESS SYSTEM AND CONTROL METHOD FOR PRESS SYSTEM

TECHNICAL FIELD

The present invention relates to a press system, and particularly to a press system for pressing a workpiece.

BACKGROUND ART

In recent years, there have been requirements for higher precision (higher precision of the shape and dimensions) of products produced through press working, and a higher pressing speed for improving the productivity.

Usually, when a process such as deep-drawing or molding for example that takes a certain long time is performed by means of a press machine, a method is generally performed according to which a load of a predetermined value or more is applied continuously to a workpiece for pressing the workpiece, from the start of pressing to the end of pressing. The load applied during this process may at least be larger than a minimum load required for molding the workpiece. When the workpiece is pressed, the slide is controlled so that a load of a predetermined value or more is applied continuously.

Generally, fatigue is accumulated in the main body of the press machine, due to the load generated during molding. The degree of fatigue that increases to exceed a limit may cause a failure or breakage of the main body of the press machine, for example.

In view of the above, the main body of the conventional press machine is overhauled at an appropriate time and maintained by replacing a part that has reached its fatigue limit, or a worn-out part, with a new part, for example.

Regarding this, Japanese Utility-Model Laying-Open No. S59-034898 and Japanese Patent Laying-Open No. H08-001396 propose a method for calculating different types of degrees of fatigue.

CITATION LIST

Patent Literature

PTL 1: Japanese Utility-Model Laying-Open No. S59-034898

PTL 2: Japanese Patent Laying-Open No. H08-001396

SUMMARY OF INVENTION

Technical Problem

According to the method disclosed in the above-cited documents, the proposed method measures the maximum load and calculates the degree of fatigue based on the measured maximum load. While this method enables calculation of the degree of fatigue of the body frame of the press machine that is directly relevant to the maximum load, it is impossible for the method to recognize the degree of fatigue of driving parts for example that constitute the press machine, resulting in a problem that it is difficult to calculate, with high precision, the degree of fatigue of the press machine as a whole.

The present invention has been made to solve the above problem, and an object of the present invention is to provide a press system and a control method for a press system that enable calculation of the degree of fatigue with high precision.

Solution to Problem

A press system according to an aspect includes: a press device configured to perform press working on a workpiece; a detection device configured to detect a press load applied for the press working by the press device; a number acquisition device configured to acquire a number of cycles of press loading, for each section of a plurality of sections into which a press loading region over a total length of a slide stroke is divided; a stress calculation device configured to calculate a stress applied to the press device, the stress corresponding to the press load for each section of the press loading region; and a degree-of-fatigue calculation device configured to calculate a degree of fatigue of the press device, based on respective stresses applied to the press device and respective numbers of cycles of press loading, for the plurality of sections of the press loading region.

A control method for a press system according to an aspect includes: performing press working on a workpiece; detecting a press load applied for the press working; acquiring a number of cycles of press loading, for each section of a plurality of sections into which a press loading region over a total length of a slide stroke is divided; calculating a stress applied to the press device, the stress corresponding to the press load for each section of the press loading region; and calculating a degree of fatigue of the press device, based on respective stresses applied to the press device and respective numbers of cycles of press loading, for the plurality of sections of the press loading region.

Advantageous Effects of Invention

The press system and the control method for the press system according to the present invention enable calculation of the degree of fatigue with high precision.

DESCRIPTION OF EMBODIMENTS

Figure 1:
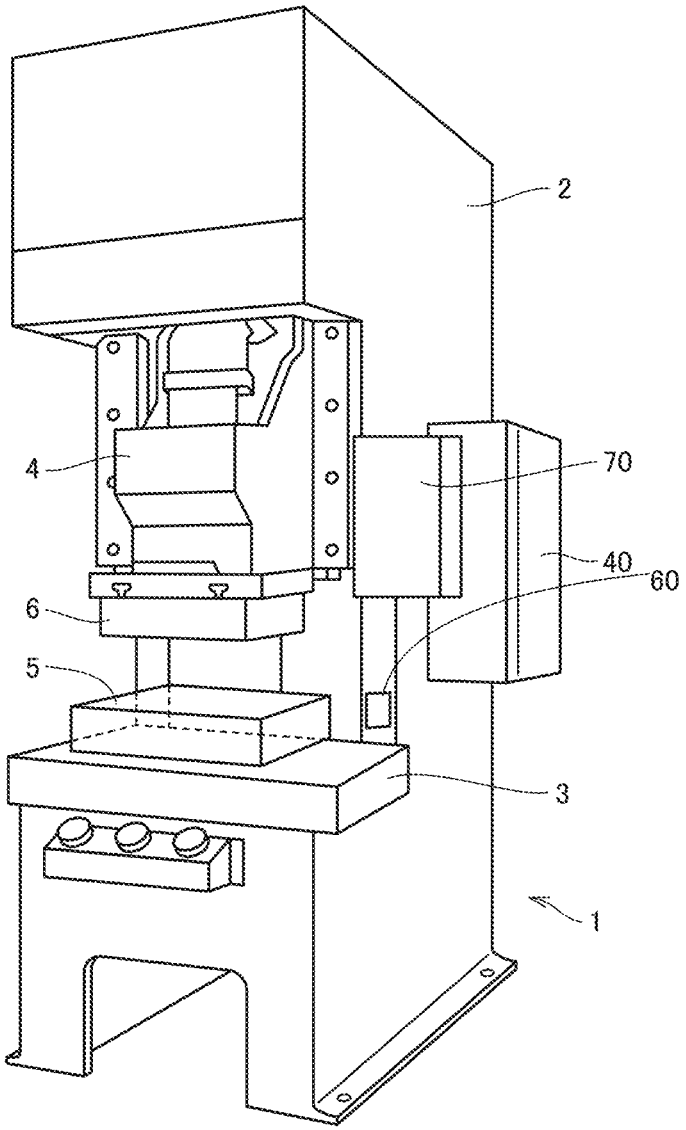
FIG. 1 illustrates an external configuration of a press machine 1 according to an embodiment.

The present embodiment is described in detail with reference to the drawings. In the drawings, the same or corresponding parts are denoted by the same reference characters, and a description thereof is not repeated.

<Overall Configuration>

FIG. 1 illustrates an external configuration of a press machine 1 according to an embodiment.

Referring to FIG. 1, press machine 1 includes a body frame 2 in the shape of the letter C as seen laterally, a bolster 3 arranged on a lower portion of body frame 2, a slide 4 supported on an upper portion of body frame 2 in such a manner that slide 4 is capable of reciprocating vertically, a control panel 70, a controller 40, and a load sensor 60.

A lower die 5 is mounted on the upper surface of bolster 3. On the lower surface of slide 4, an upper die 6 is mounted to face lower die 5.

Load sensor 60 is mounted on slide 4 to output a value of a load applied for press working.

On a lateral side of body frame 2, controller 40 is provided to control press machine 1. On the front side of body frame 2, control panel 70 is provided to manipulate press machine 1.

Figure 2:
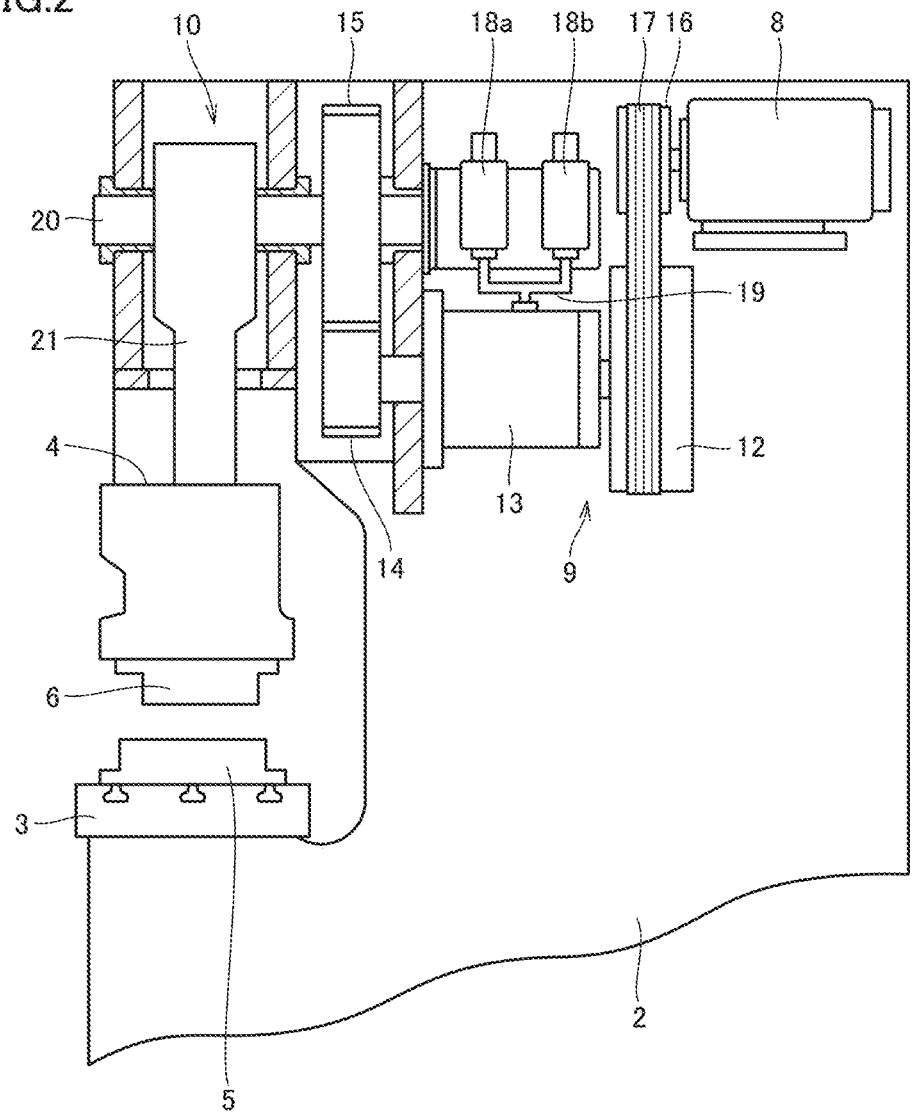
FIG. 2 illustrates a configuration of principal parts of press machine 1 according to an embodiment.

FIG. 2 illustrates a configuration of principal parts of press machine 1 according to an embodiment.

Referring to FIG. 2, an upper portion of body frame 2 is equipped with an electric motor 8, a power transmission mechanism 9, and a conversion mechanism 10 for converting rotation of electric motor 8 into reciprocating motion of slide 4.

Power transmission mechanism 9 includes a flywheel 12, a clutch and brake device 13, a first gear 14, and a second gear 15.

Flywheel 12 is coupled, through a V belt 17, to a pulley 16 fixed to an output shaft of electric motor 8. Clutch and brake device 13 is coupled to flywheel 12. In the vicinity of clutch and brake device 13, two air electromagnetic valves 18*a*, 18*b* are provided. These electromagnetic valves 18*a*, 18*b* are supplied with air from an air tank (not shown). Further, air is supplied from both electromagnetic valves 18*a*, 18*b* through an air pipe 19 to clutch and brake device 13. Thus, clutch and brake device 13 is capable of transmitting (clutch-on) rotation of flywheel 12 to first gear 14 or blocking (clutch-off) rotation of flywheel 12 from being transmitted to first gear 14. Clutch and brake device 13 is also capable of stopping (brake-on) rotation of first gear 14 or cancelling the stopping (brake-off). First gear 14 is mounted on a clutch-side of clutch and brake device 13, and second gear 15 engages with first gear 14.

Conversion mechanism 10 includes a crankshaft 20 provided coaxially with second gear 15, and a connecting rod 21 having an upper end mounted rotatably on an eccentric portion of crankshaft 20. On the lower end of connecting rod 21, slide 4 is mounted rotatably.

Press machine 1 also includes a clutch and brake control pneumatic circuit and a press angle detection device, for example (not shown). The clutch and brake control pneumatic circuit is a circuit connected to two air electromagnetic valves 18*a*, 18*b* for controlling ON and OFF of clutch and brake.

The press angle detection device is a device for detecting the rotational angular position of crankshaft 20. The press angle detection device can be used to detect the position and the direction of movement of slide 4.

<Configuration of Controller of Press Machine 1>

Next, controller 40 of press machine 1 is described.

Figure 3:
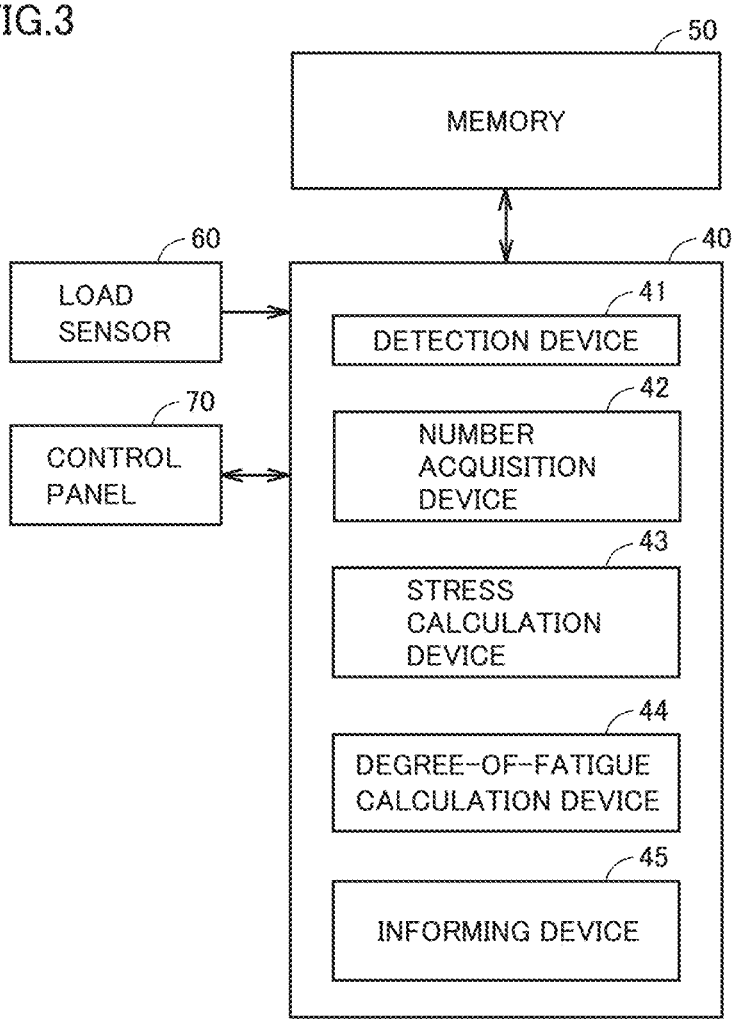
FIG. 3 is a block diagram showing a functional configuration of a controller 40 according to an embodiment.

FIG. 3 is a block diagram showing a functional configuration of controller 40 according to an embodiment.

In FIG. 3, controller 40 according to an embodiment is a device (details are not illustrated in the drawings) configured to control the whole press machine 1. Controller 40 is constituted chiefly of a CPU and a fast arithmetic processor, for example. Controller 40 includes a computer device configured to perform arithmetic and/or logical operation on input data in accordance with a predetermined procedure, and an input/output interface configured to allow input/output of command current.

Controller 40 according to an embodiment includes a detection device 41, a number acquisition device 42, a stress calculation device 43, a degree-of-fatigue calculation device 44, and an informing device 45.

Controller 40 is connected to a memory 50 configured as an appropriate storage medium such as ROM or RAM. Memory 50 stores a program for controller 40 to implement various functions. Memory 50 is also used as a working area for execution of various arithmetic operations. Memory 50 may be located either outside or inside controller 40.

Controller 40 is connected to control panel 70 and also connected to load sensor 60.

Controller 40 is capable of determining a state of a press load applied by slide 4, by means of load sensor 60. As the load sensor, a strain gauge or a hydraulic oil sensor, for example, may be used. The load sensor can be arranged appropriately at an appropriate position by those skilled in the art.

Detection device 41 is configured to receive input of measurement data taken by load sensor 60 to detect a press load applied for press working. Detection device 41 may be configured to detect the press load in accordance with an externally given instruction and perform a predetermined process.

Number acquisition device 42 is configured to acquire the number of cycles of press loading, for each section of a plurality of sections into which a press loading region over the total length of the slide stroke is divided.

Stress calculation device 43 is configured to calculate a stress applied to body frame 2, where the stress corresponds to the press load for each section of the press loading region.

Degree-of-fatigue calculation device 44 is configured to calculate the degree of fatigue of body frame 2, based on respective stresses applied to body frame 2 and respective numbers of cycles of press loading, for the plurality of sections of the press loading region.

Informing device 45 is configured to give predetermined information based on the degree of fatigue of body frame 2 calculated by degree-of-fatigue calculation device 44. Specifically, informing device 45 determines whether the calculated degree of fatigue is more than or equal to a fatigue limit, and gives alarm information when informing device 45 determines that the degree of fatigue is more than or equal to the fatigue limit. Informing device 45 may give an instruction to output alarm information as the predetermined information. Control panel 70 outputs the information on a display in accordance with the instruction. Alternatively, control panel 70 may output an alarm. If press machine 1 is connected to an external device through a network, informing device 45 may be configured to transmit alarm information through the network.

Figure 4:
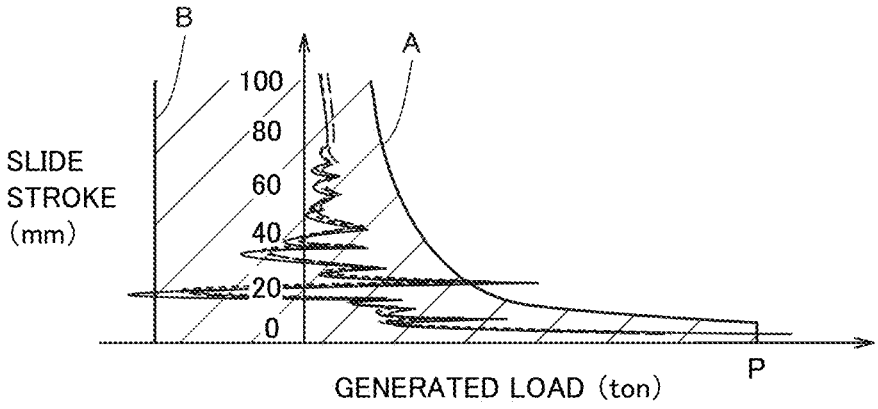
FIG. 4 illustrates load waveforms of a press load according to an embodiment.

FIG. 4 illustrates load waveforms of the press load according to an embodiment.

As shown in FIG. 4, the press load generated over the slide stroke and measured by load sensor 60 is indicated.

In this example, detected load waveforms of press loading repeated multiple times are indicated.

Detection device 41 of controller 40 detects the press load value from load sensor 60 for the overall press stroke.

In this example, an allowable ability line A representing an allowable load for a predetermined slide stroke is indicated. When a load beyond allowable ability line A is detected, it can be determined that the load is an excessive load.

In this example, a negative allowable ability line B representing a negative allowable load for a predetermined slide stroke is also indicated. When a load beyond allowable ability line B is detected, it can be determined that the load is an excessive load.

By way of example, three load waveforms for press working performed three times are indicated.

A maximum load is reached near the bottom dead center. An excessive load which is yet less than the maximum load can be applied during the press stroke before the bottom dead center is reached.

The maximum load affects body frame 2 of press machine 1. The load during the press stroke also burdens press machine 1. Specifically, the load also affects driving parts (such as electric motor 8 and power transmission mechanism 9) and the like disposed for slide 4 that are coupled to slide 4.

In this example, a description is given mainly of calculation of the degree of fatigue of body frame 2, as the degree of fatigue of press machine 1. The description is applicable not only to calculation of the degree of fatigue of body frame 2 but also to calculation of the degree of fatigue of driving parts (such as electric motor 8 and power transmission mechanism 9) and the like disposed for slide 4 of press machine 1.

Figures 5, 6:
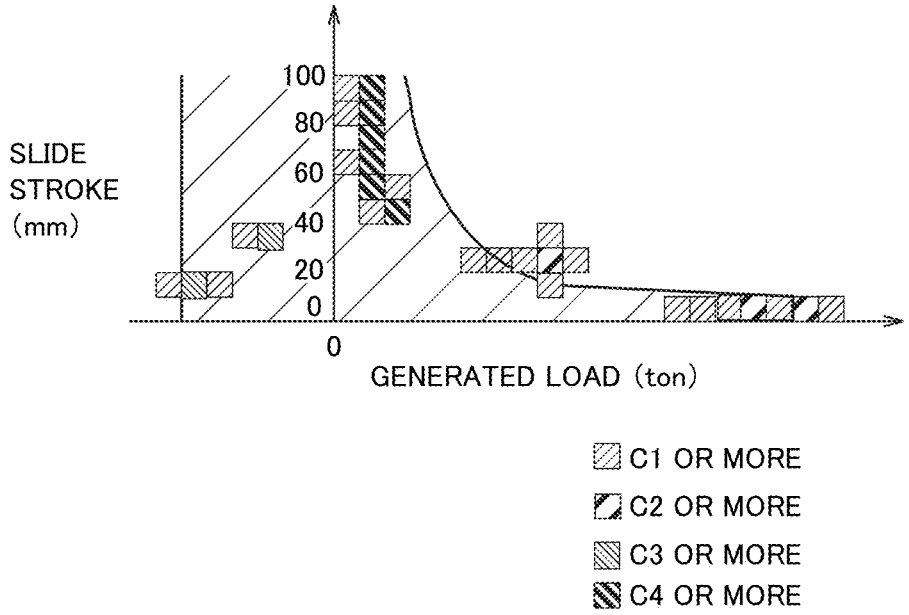
FIG. 5 illustrates the number of cycles of press loading, for each section of a press loading region according to an embodiment.
FIG. 6 shows a data table illustrating a stress applied to a body frame 2 of press machine 1 according to an embodiment.

FIG. 5 illustrates the number of cycles of press loading, for each section of the press loading region according to an embodiment.

FIG. 5 shows the number of cycles of press loading, based on the load waveforms for press working performed multiple times.

In this example, the press loading region over the total length of the slide stroke is divided into a plurality of sections (cells).

Specifically, the press loading region is divided into a plurality of sections (cells) at predetermined length intervals of the slide stroke and predetermined press load intervals.

The way to divide the press loading region into a plurality of sections (cells) is not limited to the above-described one. The press loading region may be divided at predetermined length intervals of the slide stroke into a plurality of sections (cells), or divided at predetermined press load intervals into a plurality of sections (cells). Any way to divide the press loading region may be applied as long as the press loading region over the total length of the slide stroke is divided at least into two or more sections (cells).

Number acquisition device 42 acquires the number of cycles of press loading, for each of the sections into which the press loading region is divided, in accordance with the press load detected by detection device 41. Upon detection of the press load for a specific section (cell), number acquisition device 42 increments the number of cycles of press loading for that section.

If the press load is detected for a plurality of sections (cells) at a certain length of the slide stroke, the number of cycles for a section for which the maximum load is detected among the sections may be incremented. The same is applicable to both the positive load and the negative load.

Number acquisition device 42 calculates the total number of cycles of press loading detected for each section, for the load waveforms of the press working performed multiple times.

In this example, the sections are hatched differently depending on the total count.

Specifically, hatching patterns in four stages corresponding to the total counts C1, C2, C3, and C4 are shown. The hatching patterns are not limited to them. More hatching patterns corresponding to more total counts may also be provided.

The press load distribution data is analyzed to calculate the degree of fatigue of body frame 2 of press machine 1.

FIG. 6 shows a data table illustrating the stress applied to body frame 2 of press machine 1 according to an embodiment.

As shown in FIG. 6, the stress corresponding to the maximum load is shown for each slide stroke length, by way of example.

The maximum load is the maximum value of the load for each slide stroke length, with respect to the allowable ability line.

The stress applied to body frame 2 is associated with the maximum load and stored in advance in the form of the data table in memory 50.

Specifically, the maximum load for the slide stroke length "90-100" is "P10" and the corresponding stress applied to body frame 2 is "σ10."

The maximum load for the slide stroke length "80-90" is "P9" and the corresponding stress applied to body frame 2 is "σ9."

The maximum load for the slide stroke length "70-80" is "P8" and the corresponding stress applied to body frame 2 is "σ8."

The maximum load for the slide stroke length "60-70" is "P7" and the corresponding stress applied to body frame 2 is "σ7."

The maximum load for the slide stroke length "50-60" is "P6" and the corresponding stress applied to body frame 2 is "σ6."

The maximum load for the slide stroke length "40-50" is "P5" and the corresponding stress applied to body frame 2 is "σ5."

The maximum load for the slide stroke length "30-40" is "P4" and the corresponding stress applied to body frame 2 is "σ4."

The maximum load for the slide stroke length "20-30" is "P3" and the corresponding stress applied to body frame 2 is "σ3."

The maximum load for the slide stroke length "10-20" is "P2" and the corresponding stress applied to body frame 2 is "σ2."

The maximum load for the slide stroke length "0-10" is "P1" and the corresponding stress applied to body frame 2 is "σ1."

The stress applied to body frame 2 that corresponds to the maximum load is calculated in advance through a stress analysis using the FEM (finite element method). The data table may be prepared based on actually measured values of the stress.

In this example, the stress corresponding to the maximum positive load is described. A data table is also prepared in advance for the stress corresponding to the maximum negative load.

In this example, the maximum negative load for the slide stroke length "0-100" is "P0" and the stress applied to body frame 2 that corresponds to the maximum negative load is represented as "σ0."

Figure 7:
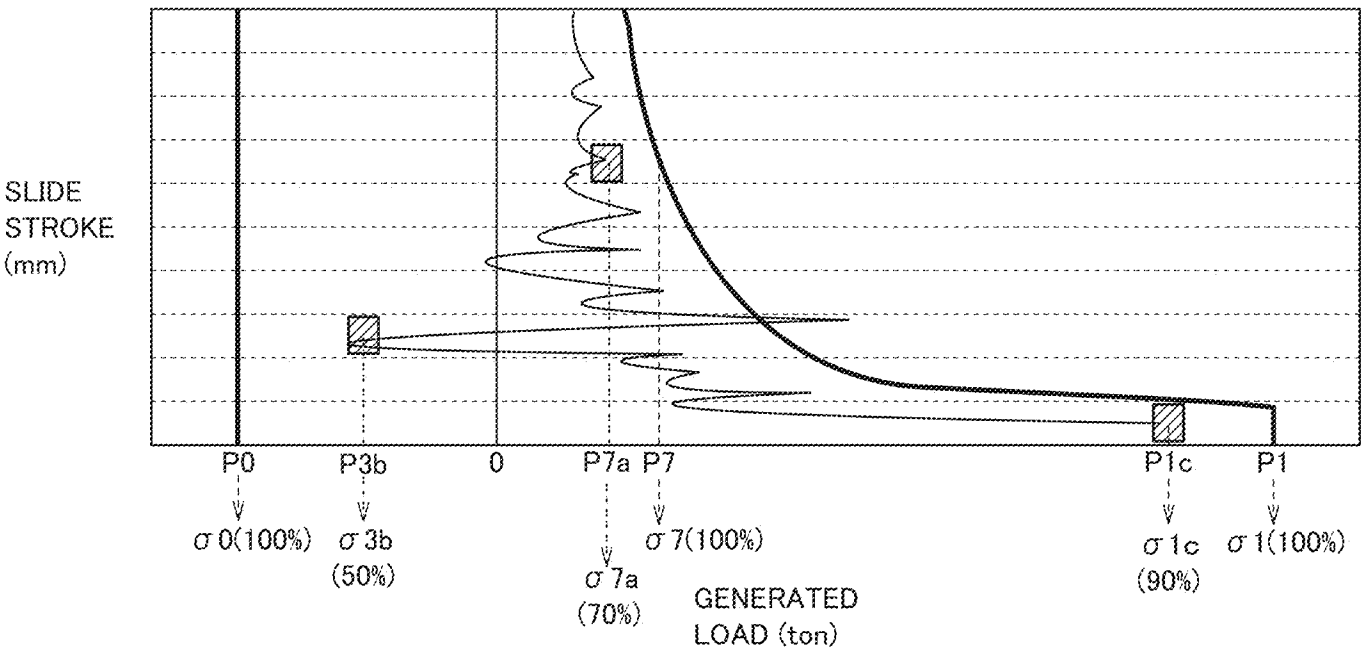
FIG. 7 illustrates the stress for predetermined sections in the press loading region divided into a plurality of sections according to an embodiment.

FIG. 7 illustrates the stress for predetermined sections of the press loading region divided into a plurality of sections according to an embodiment.

FIG. 7 shows three sections (cells).

Specifically, a case where press load P7a is detected in the range "60-70" of the slide stroke length is illustrated. A case where press load P3b is detected in the range "20-30" of the slide stroke length is also illustrated. A case where press load P1c is detected in the range "0-10" of the slide stroke length is further illustrated.

As described above with reference to FIG. 6, the maximum load in the range "60-70" of the slide stroke length is "P7" and the stress applied to body frame 2 in this case is "σ7."

Stress calculation device 43 calculates the stress applied to body frame 2 that corresponds to the press load for each section of the press loading region.

It is supposed here that press load "P7a" is about 70% of the maximum load "P7."

The stress applied to body frame 2 that corresponds to press load "P7a" is calculated by stress calculation device 43 as "σ7a." Calculated stress "σ7a" is about 70% of stress "σ7."

Likewise, the maximum negative load in the range "20-30" of the slide stroke length is "P0" and the corresponding stress applied to body frame 2 is "σ0."

It is supposed here that press load "P3b" is about 50% of the maximum load "P0."

The stress applied to body frame 2 that corresponds to press load "P3b" is calculated by stress calculation device 43 as "σ3b." Calculated stress "σ3b" is about 50% of stress "σ0."

Likewise, the maximum load in the range "0-10" of the slide stroke length is "P1" and the corresponding stress applied to body frame 2 is "σ1."

It is supposed here that press load "P1c" is about 90% of the maximum load "P1".

The stress applied to body frame 2 that corresponds to press load "P1c" is calculated by stress calculation device 43 as "σ1c." Calculated stress "σ1c" is about 90% of stress "σ1."

In this example, three sections (cells) are described. Stress calculation device 43 calculates respective stresses applied to body frame 2 for all sections of the press loading region.

Based on respective stresses calculated by stress calculation device 43 for the sections and respective numbers of cycles of press loading acquired by number acquisition device 42 for the sections, the degree of fatigue of body frame 2 is calculated.

Figure 8:
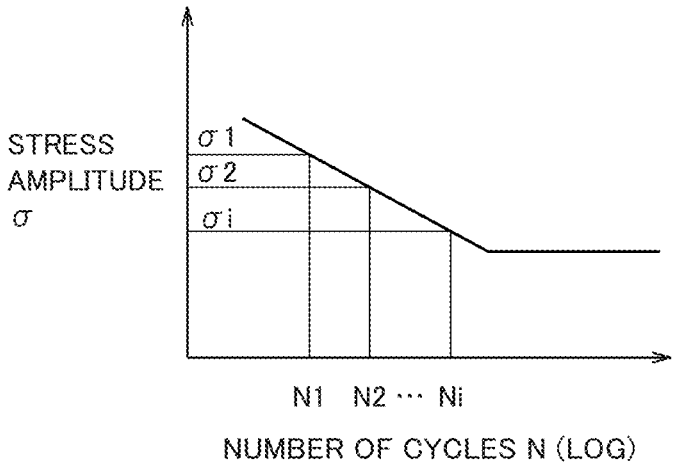
FIG. 8 illustrates a way to calculate the degree of fatigue of body frame 2 of press machine 1 according to an embodiment.

FIG. 8 illustrates a way to calculate the degree of fatigue of body frame 2 of press machine 1 according to an embodiment.

FIG. 8 (A) illustrates a case where an S—N curve (Woehler curve) is used for the cumulative fatigue damage rule.

As to the S—N curve for an object of interest, the number of cycles to failure for stress σi with a certain stress amplitude is represented as Ni.

The larger the stress amplitude σi, the smaller the number of cycles to failure Ni.

The S—N curve for an object of interest (e.g., body frame 2) is plotted based on a simulation of the stress amplitude, for example, and stored in advance in memory 50.

The degree of fatigue (linear cumulative damage) when stress σi is solely applied repeatedly ni times which is less than or equal to the number of cycles to failure is represented as ΔDi.

It is supposed that a variety of different stresses (k stresses) σ1, σ2, . . . σk are repeated solely n1, n2, . . . nk times, respectively. Degree of fatigue D accumulated in the object which is represented by a linear sum of the degrees of fatigue ΔD1, ΔD2, . . . ΔDk is represented by the formula shown in FIG. 8 (B).

When degree of fatigue D represented by $$D=(n1/N1)+(n2/N2)+(n3/N3)+\ldots$$

is more than or equal to 1, it is determined that there is a possibility of fatigue failure.

When degree of fatigue D is less than 1, it is determined that there is no possibility of fatigue failure.

In this example, degree of fatigue ΔDi of body frame 2 is calculated for all sections of the press loading region, and the sum is calculated to determine degree of fatigue D of the entire body frame 2.

Following the method described with reference to FIG. 7, stress calculation device 43 calculates the stress for each section. Degree-of-fatigue calculation device 44 calculates number of cycles to failure N corresponding to the stress for each section calculated by stress calculation device 43 based on the S—N curve. Degree-of-fatigue calculation device 44 calculates degree of fatigue ΔD for each section based on the number of cycles of press loading, for each section acquired by number acquisition device 42, and the number of cycles to failure N for each section. Degree-of-fatigue calculation device 44 determines the sum for all sections to calculate degree of fatigue D of body frame 2.

Informing device 45 determines whether degree of fatigue D is more than or equal to the fatigue limit, and provides predetermined information when it is more than or equal to the fatigue limit.

Degree of fatigue D is calculated in accordance with this method, rather than calculated based on only the measured maximum load. Therefore, degree of fatigue D can be calculated in consideration of all stresses during the slide stroke. Accordingly, the degree of fatigue of body frame 2 during the press stroke can be determined with high precision.

Figure 9:
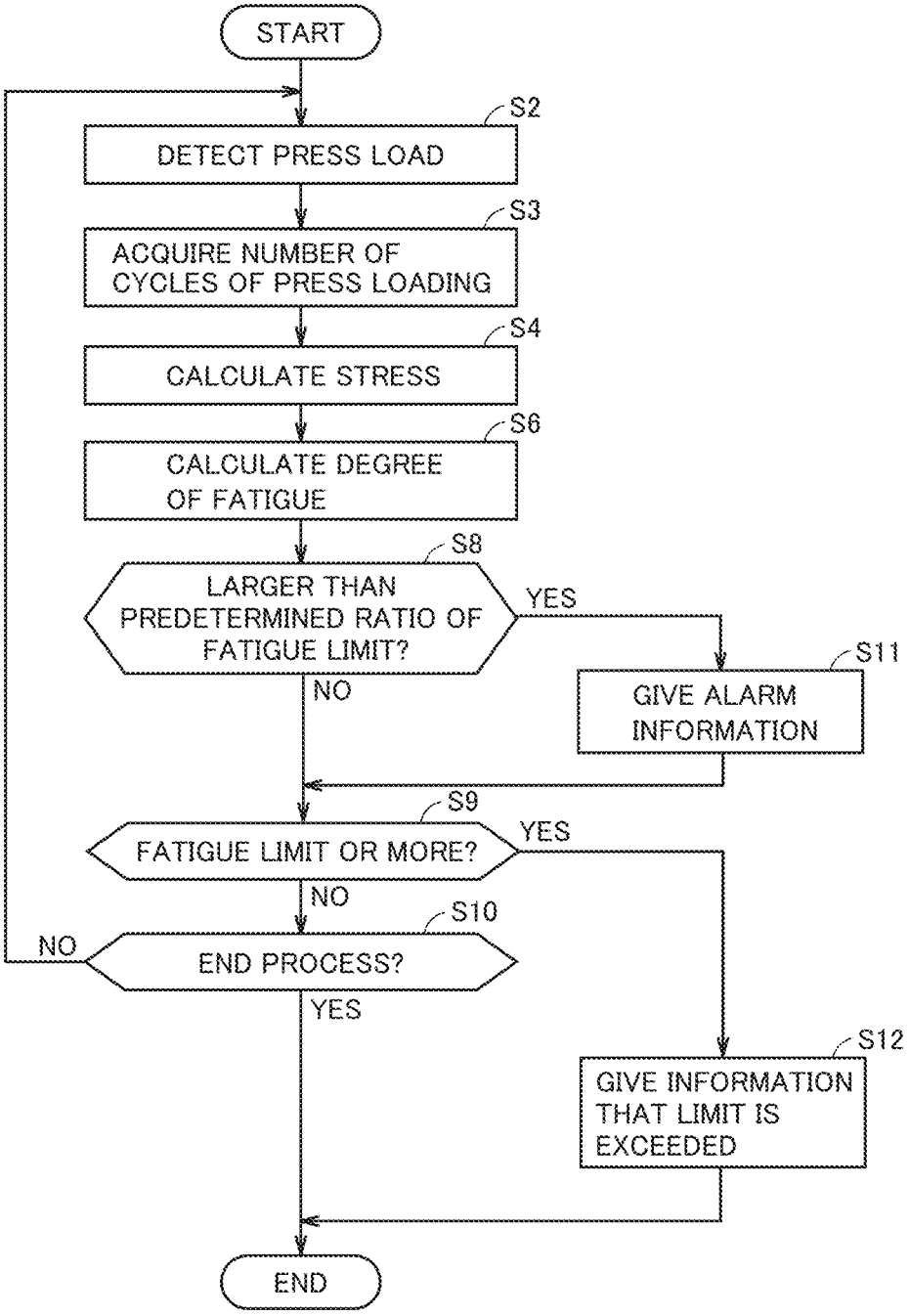
FIG. 9 is a flowchart illustrating a process for providing predetermined information by controller 40 of press machine 1 according to an embodiment.

FIG. 9 is a flowchart illustrating a process for providing predetermined information by controller 40 of press machine 1 according to an embodiment.

As shown in FIG. 9, press machine 1 detects the press load applied for press working (step S2).

Specifically, detection device 41 detects, from load sensor 60, the press load applied for press working.

Next, press machine 1 acquires the number of cycles of press loading (step S3).

Specifically, number acquisition device 42 acquires the number of cycles of press loading, for each section of a plurality of sections into which the press loading region over the total length of the slide stroke is divided as described above with reference to FIG. 5.

Next, press machine 1 calculates the stress corresponding to the press load (step S4).

Specifically, stress calculation device 43 calculates the stress applied to body frame 2 that corresponds to the press load for each section of the press loading region as described above with reference to FIG. 7, using the data table as described above with reference to FIG. 6.

Next, press machine 1 calculates degree of fatigue D (step S6).

Specifically, degree-of-fatigue calculation device 44 calculates degree of fatigue D of body frame 2 based on respective stresses applied to body frame 2 and respective numbers of cycles of press loading, for a plurality of sections of the press loading region, as described above with reference to FIG. 8.

Next, press machine 1 determines whether calculated degree of fatigue D is larger than a predetermined ratio of a fatigue limit (step S8). It is supposed that the predetermined ratio is 90% of the fatigue limit, for example. The ratio is given merely as an example, and may be set to any ratio.

Specifically, informing device 45 determines whether degree of fatigue D is larger than 0.9 or not.

In step S8, when press machine 1 determines that calculated degree of fatigue D is larger than the predetermined ratio of the fatigue limit (YES in step S8), press machine 1 gives alarm information (step S11).

Specifically, when informing device 45 determines that degree of fatigue D is larger than 0.9, informing device 45 gives alarm information as the predetermined information.

The process then proceeds to step S9.

When press machine 1 determines in step S8 that calculated degree of fatigue D is not larger than the predetermined ratio of the fatigue limit (NO in step S8), press machine 1 determines whether degree of fatigue D is more than or equal to the fatigue limit (step S9). Specifically, informing device 45 determines whether degree of fatigue D is more than or equal to 1.

When press machine 1 determines in step S9 that calculated degree of fatigue D is more than or equal to the fatigue limit (YES in step S9), press machine 1 gives information that the limit is exceeded (step S12).

Specifically, informing device 45 determines whether the degree of fatigue is more than or equal to the fatigue limit. When informing device 45 determines that the degree of fatigue is more than or equal to the fatigue limit, informing device 45 gives information that the limit is exceeded. Specifically, informing device 45 outputs, to a display of control panel 70, information for inducing maintenance. Alternatively, informing device 45 may cause an alarming sound to be output so as to inform an operator of the information that press working is performed with the press machine having a high degree of fatigue. Alternatively, such information may be transmitted to an external device (maintenance device) connected to press machine 1 through a network, so that the information can be held on the manager side.

Then, the process is ended (END). Press machine 1 may be stopped from operating after giving the information.

When press machine 1 determines in step S9 that the calculated degree of fatigue is not more than or equal to the fatigue limit (NO in step S9), press machine 1 determines whether to end the process or not (step S10).

When press machine 1 determines in step S10 that the process is to be ended (YES in step S10), press machine 1 ends the process (END).

In contrast, when press machine 1 determines in step S10 that the process is not to be ended (NO in step S10), the process returns to step S2 and the above-described operations are repeated.

The above-described method can be used to precisely calculate the degree of fatigue of body frame 2 of the press machine. Moreover, accurate predetermined information can be given based on accurate degree of precision.

While the degree of fatigue of body frame 2 is described above, this is applicable as well not only to body frame 2 but also to other driving parts constituting the press machine, for example.

Specifically, for each of the driving parts constituting the press machine, a data table, as described above with reference to FIG. 6, is provided in advance for calculating the stress applied to the driving part and the degree of fatigue of the driving part is calculated based on the S—N curve.

For example, the degree of fatigue of the connecting rod and the shaft can also be recognized. The degree of fatigue of a part such as a welded part which is difficult to measure can also be calculated.

A plurality of data tables adapted to different manufacturing steps of the press machine, different manufacturers, and different contents of metal used for manufacturing the body frame may be prepared to calculate the degree of fatigue depending on the type of the press machine. The values in the data table may not be fixed values but may be learned so that the value is updated based on a database defining a relation between a failure history and the degree of fatigue.

While the foregoing is given as being applicable to a flywheel-type press machine, it may also be applied to a press machine having an electric servo motor.

In this example, while the functional components of controller 40 are described as components provided in the press machine, the functional components are not limited to the press machine but may be functional components of a press system including the press machine. For example, in the case where the functional components are connected to an external server through a network, the functions may also be performed in cooperation with a CPU of the external server. Specifically, respective functions of number acquisition device 42, stress calculation device 43, degree-of-fatigue calculation device 44, and informing device 45 may be performed in an external server. Further, the display on which the information is indicated is not limited to the display of the press machine. The information may also be indicated on a display of a terminal connectable to the press machine through a network.

<Operational Advantages>

In the following, operational advantages of the embodiments are described.

A press system according to an embodiment includes, as shown in FIGS. 1 and 3, a press device which includes slide 4 for performing press working on a workpiece, detection device 41, number acquisition device 42, stress calculation device 43, and degree-of-fatigue calculation device 44. Detection device 41 is configured to detect a press load applied for the press working by slide 4. Number acquisition device 42 is configured to acquire the number of cycles of press loading, for each section of a plurality of sections into which the press loading region over the total length of the slide stroke is divided. Stress calculation device 43 is configured to calculate a stress applied to body frame 2, the stress corresponding to the press load for each section of the press loading region. Degree-of-fatigue calculation device 44 is configured to calculate a degree of fatigue of body frame 2, based on respective stresses applied to body frame 2 and respective numbers of cycles of press loading, for the plurality of sections of the press loading region.

The degree of fatigue of body frame 2 is calculated based on respective stresses applied to body frame 2 and respective numbers of cycles of press loading, for a plurality of sections. According to this method, it is possible to calculate the degree of fatigue in consideration of all stresses during the slide stroke. The degree of fatigue can thus be calculated with high precision.

The press system further includes informing device 45. Informing device 45 is configured to give predetermined information based on the degree of fatigue of the press device calculated by degree-of-fatigue calculation device 44.

Informing device 45 can give predetermined information based on the degree of fatigue, and therefore, the degree of fatigue can be recognized easily.

The press loading region is divided into a plurality of sections based on at least one of predetermined length intervals of the slide stroke and predetermined press load intervals.

The division into a plurality of sections enables calculation of the degree of fatigue in consideration of all stresses during the slide stroke. The degree of fatigue can thus be calculated with high precision.

Degree-of-fatigue calculation device 44 is configured to calculate a degree of fatigue based on the stress applied to the press device and the number of cycles of press loading, for each section of the press loading region, and calculate the degree of fatigue of the press device by determining a sum of respective degrees of fatigue for the plurality of sections.

As shown in FIG. 8, degree-of-fatigue calculation device 44 calculates degree of fatigue ΔD for each section. Degree-of-fatigue calculation device 44 calculates the sum of respective degrees of fatigue for all sections to thereby calculate degree of fatigue D of body frame 2. It is thus possible to calculate degree of fatigue D in consideration of all stresses during the slide stroke, rather than calculating the degree of fatigue by measuring only the maximum load. The degree of fatigue can thus be calculated with high precision.

Informing device 45 is configured to give first predetermined information when the degree of fatigue of the press device calculated by degree-of-fatigue calculation device 44 is larger than a first predetermined value. Informing device 45 is configured to give second predetermined information when the degree of fatigue of the press device calculated by degree-of-fatigue calculation device 44 is larger than a second predetermined value.

Informing device 45 gives the first predetermined information or the second predetermined information, depending on the degree of fatigue of the press device. It is therefore possible to give appropriate information depending on the degree of fatigue.

A control method for a press system according to an embodiment includes: the step of performing press working on a workpiece; the step S2 of detecting a press loading applied for the press working; the step S3 of acquiring a number of cycles of press loading, for each section of a plurality of sections into which a press loading region over a total length of a slide stroke is divided; the step S4 of calculating a stress applied to the press device, the stress corresponding to the press load for each section of the press loading region; and the step S6 of calculating a degree of fatigue of the press device, based on respective stresses applied to the press device and respective numbers of cycles of press loading, for the plurality of sections of the press loading region.

The degree of fatigue of body frame 2 is calculated based on respective stresses applied to body frame 2 and respective numbers of cycles of press loading, for a plurality of sections. It is therefore possible to calculate the degree of fatigue in consideration of all stresses during the slide stroke. The degree of fatigue can thus be calculated with high precision.

It should be construed that the embodiments disclosed herein are given by way of illustration in all respects, not by way of limitation. It is intended that the scope of the present invention is defined by claims, not by the description above, and encompasses all modifications and variations equivalent in meaning and scope to the claims.

REFERENCE SIGNS LIST

1 press machine; 2 body frame; 3 bolster; 4 slide; 5 lower die; 6 upper die; 8 electric motor; 9 power transmission mechanism; 10 conversion mechanism; 12 flywheel; 13 brake device; 14 first gear; 15 second gear; 16 pulley; 17 belt; 40 controller; 41 detection device; 42 number acquisition device; 43 stress calculation device; 44 degree-of-fatigue calculation device; 45 informing device; 50 memory; 60 load sensor; 70 control panel

The invention claimed is:

1. A press system comprising:

a press device configured to perform press working on a workpiece;

a detection device configured to detect a press load applied for the press working by the press device;

a number acquisition device configured to acquire a number of cycles of press loading, for each section of a plurality of sections into which a press loading region over a total length of a slide stroke is divided, wherein the press loading region is divided into the plurality of sections at predetermined length intervals of the slide stroke;

a stress calculation device configured to calculate a stress applied to the press device, the stress corresponding to the press load for each section of the press loading region; and a degree-of-fatigue calculation device configured to calculate a degree of fatigue of the press device, based on respective stresses applied to the press device and respective numbers of cycles of press loading, for the plurality of sections of the press loading region.

2. The press system according to claim 1, further comprising an informing device configured to give predetermined information based on the degree of fatigue of the press device calculated by the degree-of-fatigue calculation device.

3. The press system according to claim 1, wherein the press loading region is divided into the plurality of sections further based on predetermined press load intervals.

4. The press system according to claim 1, wherein the degree-of-fatigue calculation device is configured to calculate a degree of fatigue based on the stress applied to the press device and the number of cycles of press loading, for each section of the press loading region, and calculate the degree of fatigue of the press device by determining a sum of respective degrees of fatigue for the plurality of sections.

5. The press system according to claim 2, wherein the informing device is configured to give first predetermined information when the degree of fatigue of the press device calculated by the degree-of-fatigue calculation device is larger than a first predetermined value, and second predetermined information when the degree of fatigue of the press device calculated by the degree-of-fatigue calculation device is larger than a second predetermined value.

6. A control method for a press system, the control method comprising:

performing press working on a workpiece;

detecting a press load applied for the press working;

acquiring a number of cycles of press loading, for each section of a plurality of sections into which a press loading region over a total length of a slide stroke is divided, wherein the press loading region is divided into the plurality of sections at predetermined length intervals of the slide stroke;

calculating a stress applied to a press device, the stress corresponding to the press load for each section of the press loading region; and calculating a degree of fatigue of the press device, based on respective stresses applied to the press device and respective numbers of cycles of press loading, for the plurality of sections of the press loading region.

* * * * *